US005952634A

United States Patent [19]

Yoshida

[11] Patent Number: 5,952,634

[45] Date of Patent: Sep. 14, 1999

[54] DRIP-PROOF TACTILE PUSH BUTTON SWITCH

[75] Inventor: Noboru Yoshida, Sawa-gun, Japan

[73] Assignee: Hosiden Corporation, Osaka, Japan

[21] Appl. No.: 09/106,084

[22] Filed: Jun. 29, 1998

[30] Foreign Application Priority Data

Jul. 11, 1997 [JP] Japan ..... 9-186497

[51] Int. Cl.[6] ..... H01H 13/06

[52] U.S. Cl. ..... 200/302.2

[58] Field of Search ..... 200/302.2, 302.1; 400/479; 174/66

[56] References Cited

U.S. PATENT DOCUMENTS

| | | | |
|---|---|---|---|
| 2,740,024 | 3/1956 | Rogers | 200/302.2 |
| 4,394,548 | 7/1983 | Dola | 200/6 A |
| 4,436,965 | 3/1984 | Morse | 200/302.2 X |
| 4,698,471 | 10/1987 | Piber | 200/302.2 |

*Primary Examiner*—Renee S. Luebke
*Attorney, Agent, or Firm*—Pollock, Vande Sande & Amernick

[57] ABSTRACT

A tactile push button switch has a switch mechanism and a push button for driving the switch mechanism provided in a box-shaped switch case having a switch cover. The top of the push button protrudes upwardly of the switch cover through an opening made therein, and a drip-proof member made of sponge material is bonded to the top of the switch cover around the protruding push button.

7 Claims, 6 Drawing Sheets

DRIP-PROOF TACTILE PUSH BUTTON SWITCH

BACKGROUND OF THE INVENTION

1. Field of the Invention

The present invention relates to a tactile push button switch and, more particularly, to a drip-proof structure for such a switch.

2. Description of the Prior Art

Referring first to FIGS. 1, 2 and 3, a prior art example will be described.

A tactile push button switch 20 has a switch case 11 and a switch cover 12. The switch case 11 has at its center a first fixed contact 31 formed integrally therewith, from which terminals 34*a* and 34*b* lead off for external connection use. Similarly formed integrally in the switch case 11 are two second fixed contacts 32 and 33, from which terminals 35 and 36 (hidden behind terminals 34*a* and 34*b*, respectively) lead off for external connection use. A dome-shaped reversing contact 14 is formed of a resilient spring material such as phosphor bronze and has a marginal portion 42 rested on the bottom of the case 11 and held in contact with the second fixed contacts 32 and 33 exposed on the bottom of the case 11. Reference numeral 41 denotes the top or vertex of the dome-shaped reversing contact 14. Upon depression of a push button 15, the dome-shaped reversing contact 14 is pressed downward by a protrusion 52 of the push button 15, and the contact 14 rapidly reverses into top down position with a click the instant its vertex 41 reaches a dead center. The push button 15 has the protrusion 52 protrusively provided on the underside of the push button body and a flange 53 extended about its periphery. The push button 15 slightly projects upwardly of the surface of the switch cover 12 through an opening 12A bored therethrough. The switch case 11 and the switch cover 12 are ultimately molded into a watertight unitary structure.

In the normal condition with the push button 15 left unpressed, the dome-shaped reversing contact 14 retains its original shape by virtue of its own resiliency, and hence it pushes upward the push button 15 through its protrusion 52, urging its flange 53 against the underside of the switch cover 12 and holding the push button 15 at its raised position. In this instance, the dome-shaped reversing contact 14 is not in contact with the first fixed contact 31, holding the switch open. In other words, the terminals 34*a*, 34*b* and the terminals 35, 36 are electrically disconnected and no current flows therethrough.

Upon depression of the push button 15, the dome-shaped reversing contact 14 is pressed down and deformed by the protrusion 52, and the instant the vertex 41 of the dome reaches dead center, the contact 14 reverses into a top down position, bringing the vertex 41 into contact with the first fixed contact 31 centrally thereof as indicated by 30. As the result, the first fixed contact 31 is electrically connected through the dome-shaped reversing contact 14 to the second fixed contacts 32 and 33, permitting the passage of current through the terminals 34*a*, 34*b* and 35, 36.

Turning next to FIG. 4, a description will be given of how tactile push button switches are used in practice. The switch 20 now in practical use usually has outer dimensions of a 5 mm width, a 5 mm depth and a 3 mm thickness at the largest. A number of such miniature switches 20 are fixedly mounted in a matrix form on the surface of a wiring board of a keyboard or like electric equipment and received in its housing. Reference numeral 17 denotes a top panel of the housing in which to receive the wiring board 16 with a number of tactile push button switches 20 fixedly mounted thereon; 71 denotes an annular shoulder defining or surrounding an aperture in the top panel 17 of the housing; 72 denotes an operating key loosely fitted in the aperture; 73 denotes an operating rod planted on the underside of the operating key 72; and 74 denotes a flange extending integrally from the outer peripheral edge of the operating key 72 at the lower end thereof.

In the normal state during which period the operating key 72 is not being pressed, it is pushed up by the push button 15 of the switch 20 and held at its raised position where the flange 74 is urged into engagement with the annular shoulder 71 around the aperture. By pressing the operating key 72, the push button switch 20 can be put in operation through the operating rod 73 and the push button 15.

Generally speaking, it is impossible to provide a completely watertight structure between the annular shoulder 71 of the top panel 17 surrounding its aperture and the flange of the operating key 72. Waterdrops permeate into the housing from between the marginal edge of the annular shoulder 71 and the flange 74 of the operating key 72 not only when they are disengaged from each other by the depression of the operating key 72 but also when they are engaged with each other. Incidentally, the switch 20 has its switch case 11, switch cover 12 and terminals 34 and 35 integrally molded into a completely watertight one-piece structure; however, the switch 20 is not watertight between the underside of the switch cover 12 and the flange 53 of the push button 15. When such a switch 20 is used, for example, in various portable remote controllers or portable telephones, care should be taken not to admit waterdrops into the opening 12A of the switch cover 12 over the entire circumference thereof. That is, waterdrops, once admitted into the housing of a keyboard or similar electrical equipment, are likely to stream into the switch 20 from between the underside of the switch cover 12 and the flange 53 of the push button 15.

SUMMARY OF THE INVENTION

It is therefore an object of the present invention to provide a push button switch that obviates the above-mentioned problem and hence effectively prevents the admission thereinto of water.

According to the present invention, there is provided a tactile switch which has a push button slightly projecting upwardly of a switch cover through an opening made in a switch case and the switch cover integrally formed as a watertight unitary structure and in which the upward-projecting push button is surrounded by a drip-proof sponge member mounted on the top of the switch cover.

In the above switch, the drip-proof sponge member may be made, for example, of closed or open cell sponge.

DETAILED DESCRIPTION OF THE PREFERRED EMBODIMENTS

Figure 4:
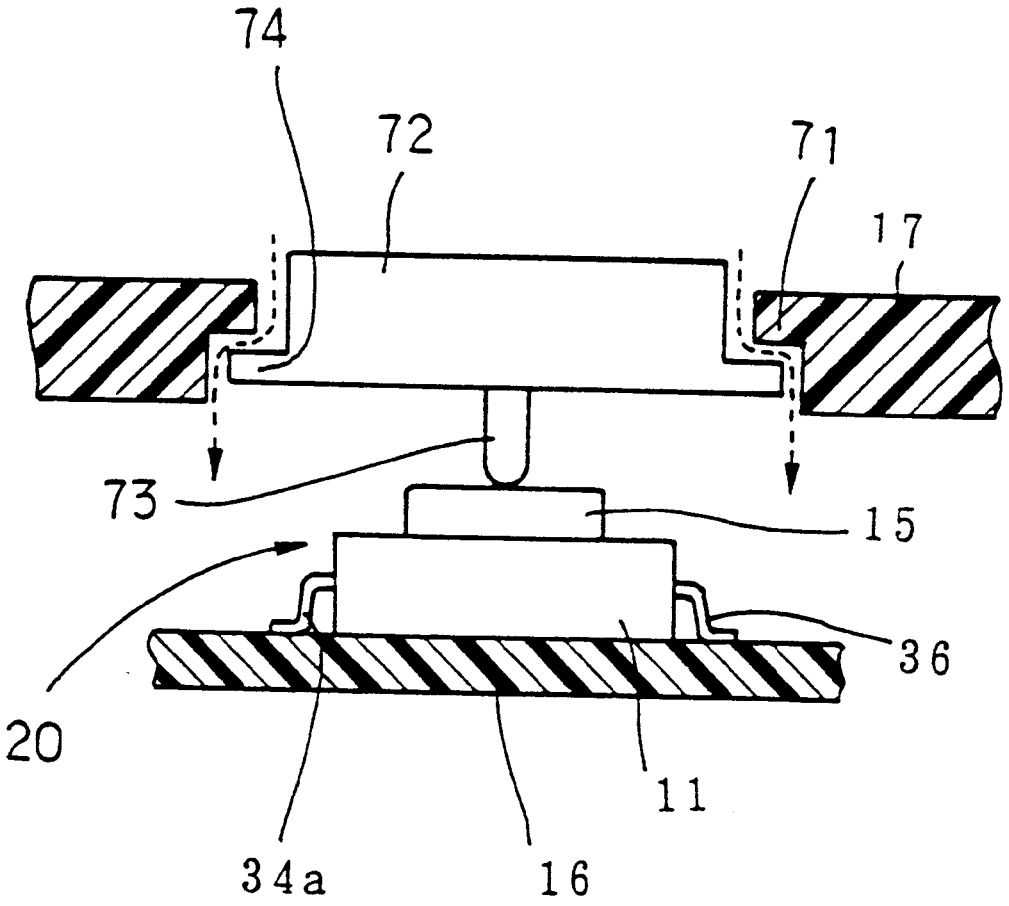
FIG. 4 PRIOR ART
FIG. 4 is a diagram showing the switch of FIG. 1 in a housing.
Figure 5:
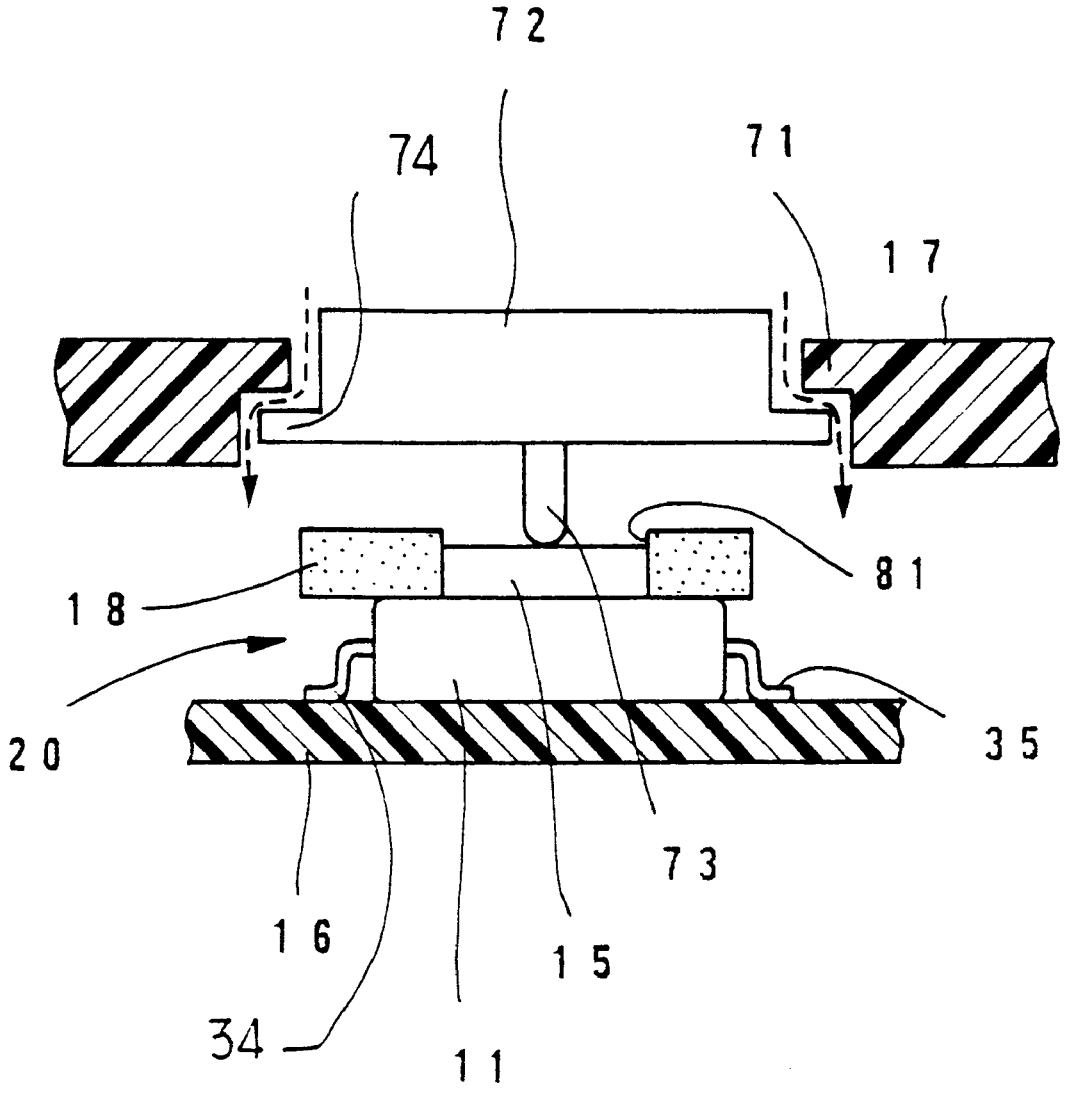
FIG. 5 is a diagram showing the a tactile push button switch according to the present invention in a housing.

An embodiment of the present invention will be described with reference to FIG. 5, in which the same reference numerals as those in FIG. 4 are assumed to denote the parts identical with those used therein.

Figure 1:
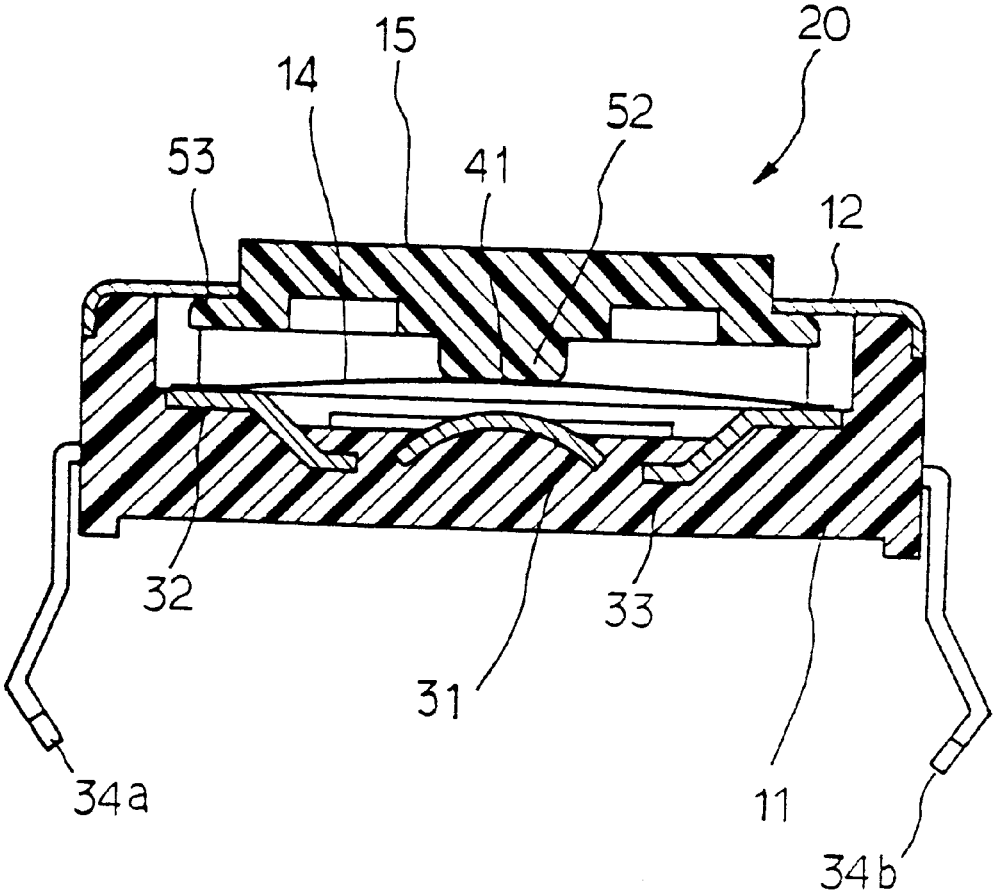
FIG. 1 PRIOR ART
FIG. 1 is a diagram for explaining a conventional tactile push button switch.
Figure 2:
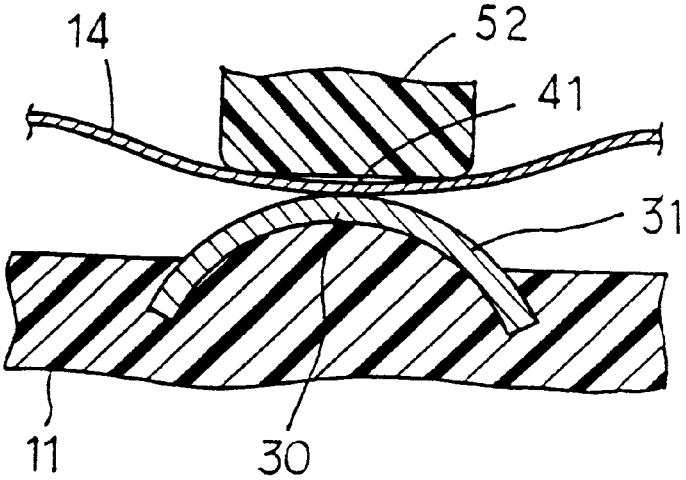
FIG. 2 PRIOR ART
FIG. 2 is a partially enlarged sectional view of a portion of the switch depicted in FIG. 1.
Figure 3:
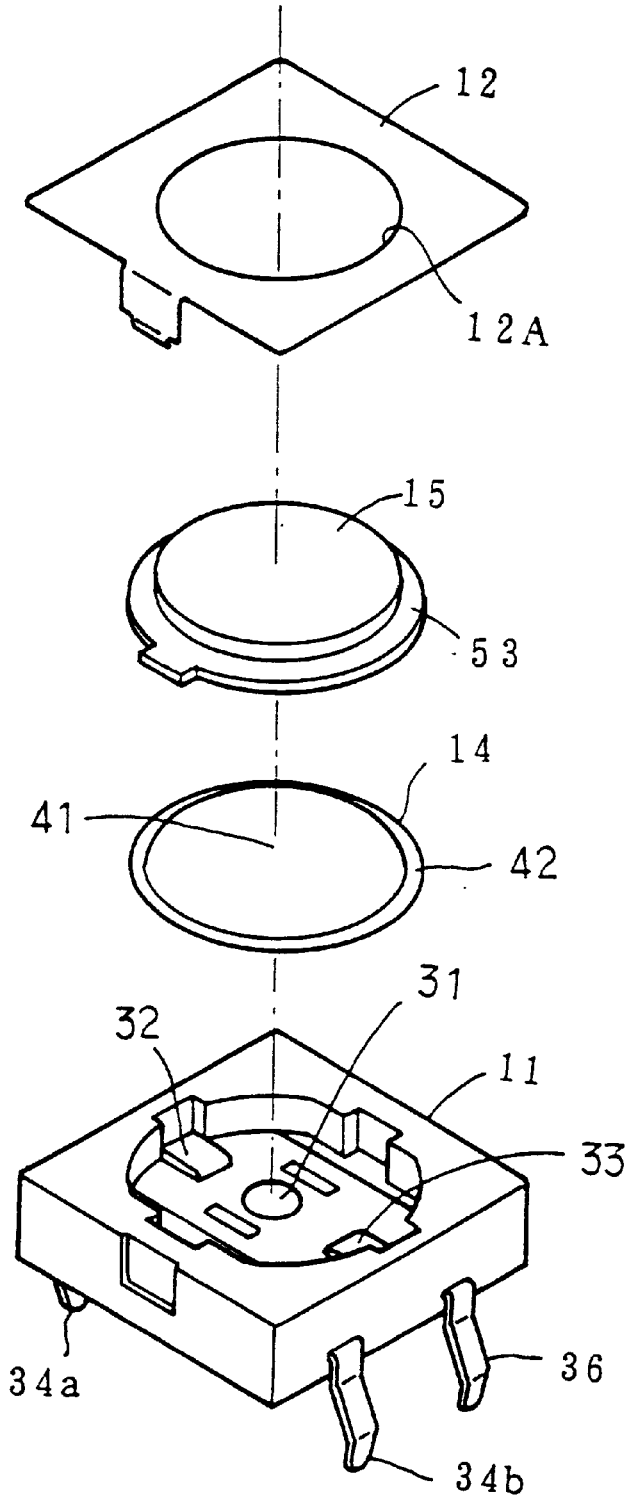
FIG. 3 PRIOR ART
FIG. 3 is an exploded perspective view of the switch depicted in FIG. 1.

The switch 20 of the present invention is identical in construction with the prior art example of FIGS. 1 through 3. As shown in FIGS. 1–3, the push button 15 shown in FIG. 5 projects out of an opening 12A of a switch cover 12 mounted on the top of the switch case 11. The switch 20 is fixedly mounted on the surface of a wiring board 16 and placed in the housing. The operating rod 73 engages the push button 15 of the switch 20. In the normal state during which the operating key 72 is not being pressed, it is pushed up by the push button 15, slightly protrudes beyond the surface of the panel 17, and is held at its raised position where the flange 74 is urged against underside of the annular shoulder 71 all around the aperture in panel 17. By pressing the operating key 72, the switch 20 can be actuated through the operating rod 73 and the push button 15.

In the switch 20 according to the present invention, there is provided a drip-proof sponge member 18 on the top of the switch case 11, that is, on the switch cover 12 in a manner to surround the push button 15. The drip-proof sponge member 18 may preferably be formed using a very thin sheet of closed or open cell sponge. The drip-proof sponge member 18 has an aperture 81 corresponding to the push button 15 of the switch 20. The inner diameter of the aperture 81 may be slightly smaller or larger than the outer diameter of the push button 15. The underside of the drip-proof sponge member 18 and the top of the switch case 11 are bonded by adhesive or pressure sensitive adhesive double coated tape. The outer diameter of the drip-proof sponge member 18 may be smaller or larger than the outer diameter of the operating key 72. The important point here is to prevent water that has been admitted into the housing from steaming down onto the surface of the switch cover 12 and into its opening 12A (see FIG. 3). A closed cell sponge is a soft material that is extremely low in rigidity and has rubberlike elasticity; since the sponge cells are isolated and not interconnecting, this material does not transmit therethrough water or liquid. An open cell sponge is also a soft material that is extremely low in rigidity and has rubberlike elasticity; although its cells are not isolated, there is substantially no risk of water permeating this material if the amount of water is very small.

Figure 6A:
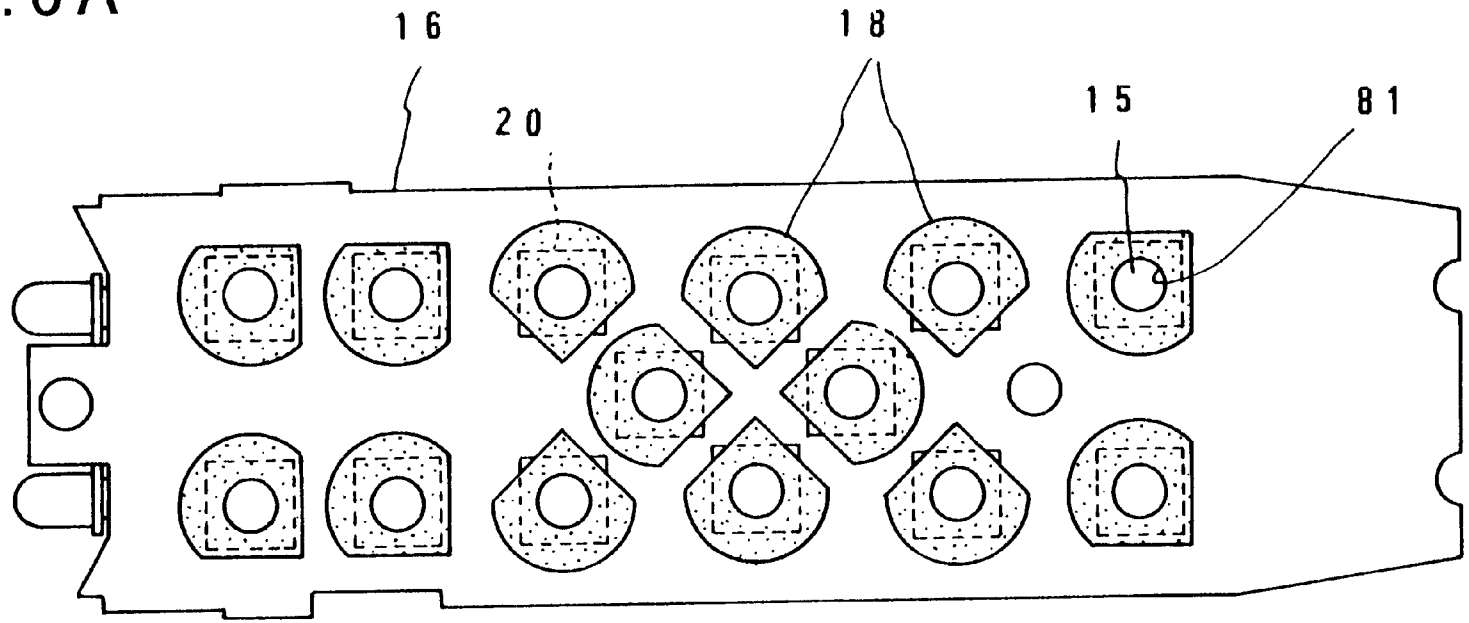
FIG. 6A is a plan view illustrating an embodiment of the present invention.
Figure 6B:
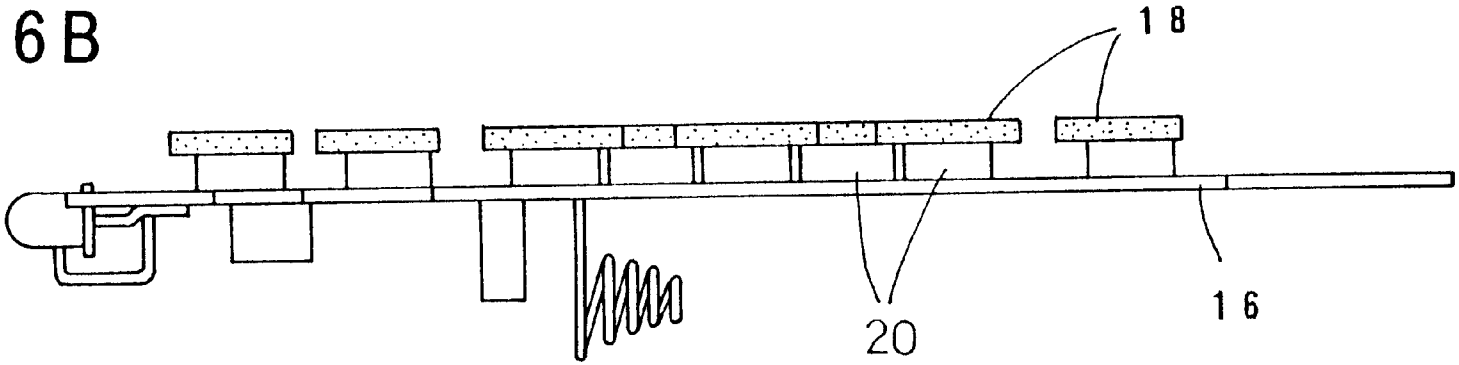
FIG. 6B is a side view of the FIG. 6A embodiment.

FIGS. 6A and 6B are a plan and a side view of the wiring board 16 with a plurality of tactile push button switches 20 arranged thereon with close but equal spacing. The drip-proof sponge members 18 of four adjoining switches 20 each have a perimeter composed of two sides which intersect at right angles so that the opposing sides of adjacent members 18 are straight and parallel to each other with a circular arc joining distant ends of these two sides. With such an arrangement, the four switches can be disposed close to each other. In this example separate drip-proof sponge members 18 are used respectively for each of the switches 20, taking up necessary but minimal area on the wiring board 16. Other electrical parts may also be mounted on the wiring board 16, in which case, too, drip-proof sponge members 18 can be used for the switches 20 independently of such other electrical parts.

Figure 7:
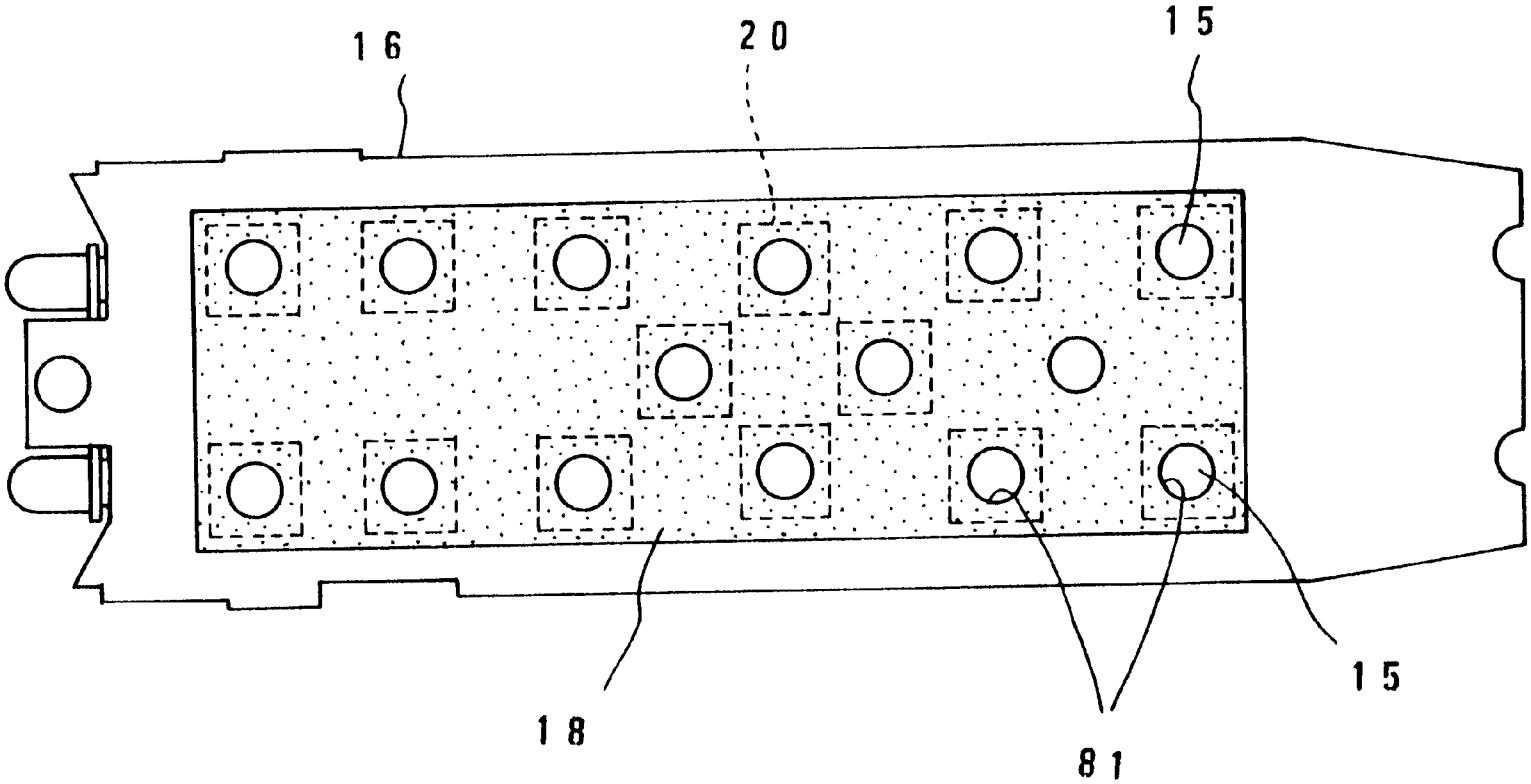
FIG. 7 is a diagram illustrating another embodiment of the present invention.

FIG. 7 depicts an example which employs a single sheet of drip-proof sponge material 18 for the plurality of switches 20 shown in FIGS. 6A and 6B. In the keyboard assembling step, the single sheet drip-proof sponge 18, which has apertures 81 corresponding to push buttons 15 of the respective switches 20, is bonded to the top of every switch 20 at one time. By this, drip-proof means can efficiently be provided for a large number of switches 20. In this instance, even if waterdrops happen to be admitted into the housing from between the annular shoulder 71 around the aperture in the top panel 17 and the flange 74 of operating key 72 as indicated by the arrows in FIGS. 4 and 5, they can be partly absorbed or adsorbed before they stream down into the associated switch 20.

EFFECT OF THE INVENTION

As described above, while the switch case 11, the switch cover 12 and the terminals 34 and 35 of the switch 20 are integrally molded into a completely watertight structure, usually no measures are taken to avoid the admission of water from between the underside of the switch cover 12 and the flange 53 of the push button 15. According to the present invention, it is possible to render the switch 20 waterproof simply by bonding the drip-proof sponge member 18 to the top of the switch cover 12 around the upward-protruding push button 15 without taking any additional measures therefor in the switch 20.

The closed or open cell sponge used as the drip-proof member 18 is a soft material that is extremely low in rigidity and has rubberlike elasticity as referred to above. Hence, even if the diameter of the aperture in the drip-proof member 18 is made smaller than the diameter of the push button 15, practically no mechanical resistance will be encountered in the operation of the push button 15.

It will be apparent that many modifications and variations may be effected without departing from the scope of the novel concepts of the present invention.

What is claimed is:

1. A tactile push button switch comprising:

a box-shaped switch case having a switching mechanism housed therein;

a switch cover covering said switch case and having an opening therein;

a push button disposed in engagement with said switching mechanism and protruding upwardly of said switch cover through said opening; and a drip-proof sponge member having an aperture surrounding said push button and bonded to a top of said switch cover.

2. The switch of claim 1, wherein said drip-proof sponge member is made of closed cell sponge material.

3. The switch of claim 1, wherein said drip-proof sponge member is made of open cell sponge material.

4. The switch of claim 1, 2, or 3, wherein said push button has, within said switch case, a flange that engages an underside of an annular shoulder portion around said opening of said switch cover.

5. The switch of claim 1, 2, or 3, wherein said switching mechanism comprises: a first fixed contact disposed in a bottom of said switch case centrally thereof; a pair of diametrically opposed second fixed contacts spaced outwardly of said first fixed contact; first and second terminals leading off said first and second fixed contacts, respectively, and extending out of said switch case; and a dome-shaped reversing contact which is normally in contact with said second fixed contacts and is adapted to be reversed in position into a top down position for contact with said first fixed contact, an underside of said push button resting on a vertex of said dome-shaped reversing contact.

6. A switch assembly comprising a plurality of switches that are respectively constructed in accordance with claim 1, 2, or 3 arranged with predetermined spacing from one another on a wiring board, said drip-proof sponge member for each of said switches having a perimeter composed of two sides intersecting substantially at right angles and a circular arc joining far ends of said two sides.

7. A switch assembly wherein a plurality of switches, respectively constructed in accordance with claim 1, 2, or 3, are arranged with predetermined spacing from one another on a wiring board, and said drip-proof sponge members for said switches are provided as a single sheet of sponge material that covers all of said plurality of switches.

* * * * *